United States Patent [19]

Prang

[11] Patent Number: 5,044,820

[45] Date of Patent: Sep. 3, 1991

[54] ROAD-FINISHING APPARATUS WITH IMPROVED CONTROL OVER LAYING BEAM

[75] Inventor: Robert Prang, Hameln, Fed. Rep. of Germany

[73] Assignee: ABG-Werke GmbH, Hameln, Fed. Rep. of Germany

[21] Appl. No.: 492,699

[22] Filed: Mar. 13, 1990

[30] Foreign Application Priority Data

Mar. 23, 1989 [DE] Fed. Rep. of Germany ..... 3909583

[51] Int. Cl.[5] ..... E01C 19/00

[52] U.S. Cl. ..... 404/84; 404/101

[58] Field of Search ..... 404/84, 85, 101

[56] References Cited

U.S. PATENT DOCUMENTS

| | | | |
|---|---|---|---|
| 3,181,441 | 5/1965 | Flom | 404/84 |
| 3,210,710 | 10/1965 | Amos | 404/84 X |
| 3,285,148 | 11/1966 | Munyon | 404/84 |
| 3,334,560 | 8/1967 | Long et al. | 404/84 |
| 3,554,291 | 1/1971 | Rogers | 404/84 X |
| 3,564,986 | 2/1971 | Burgin | 404/84 |
| 3,953,145 | 4/1976 | Teach | 404/84 |
| 4,473,319 | 9/1984 | Spangler | 404/84 X |
| 4,925,840 | 5/1990 | Heiser et al. | 404/84 X |
| 4,943,119 | 7/1990 | Zarniko et al. | 404/84 X |
| 4,948,292 | 8/1990 | Haven et al. | 404/84 |

FOREIGN PATENT DOCUMENTS 2003288 4/1983 Fed. Rep. of Germany ..... 404/84

*Primary Examiner*—Ramon S. Britts
*Assistant Examiner*—Gay Ann Spahn
*Attorney, Agent, or Firm*—Townsend and Townsend

[57] ABSTRACT

The invention relates to a road-finishing machine with a laying beam (2) which is provided with control members (8) for adjusting the height and inclination of the laying beam (2) as well as measuring sensors for this purpose, the output signals of the measuring sensors serving as actual values for adjusters (10, 11) controlling the control members (8) in accordance with desired values which can be predetermined. In order to be able to automatically maintain transverse inclination values according to a predetermined profile plan, it is provided that a path measurement device (12) is provided, the output signals of which can be fed to an onboard computer (14), the onboard computer (14) being provided along the laying path with a data store (17) for storing the length of a transitional section and the differential value of the transverse inclination, which differential value is to be maintained between the starting and finishing point of the transitional section, and it being possible for the desired values, which can be predetermined and are calculated by the onboard computer (14) for the inclination adjuster (11), to be altered continually by the onboard computer (14) depending on the road surface from the starting to the finishing point.

12 Claims, 2 Drawing Sheets

ROAD-FINISHING APPARATUS WITH IMPROVED CONTROL OVER LAYING BEAM

The invention relates to a road-finishing machine with a laying beam which is provided with control members for adjusting the height and inclination of the laying beam, as well as measuring sensors for this purpose, the output signals of the measuring sensors serving as actual values for adjusters controlling the control members according to desired values which can be predetermined.

For road-finishing machines of this type, it is known that the laying heights or transverse inclinations of the layer to be laid can be monitored using adjustment devices and corrected if necessary. The adjustment devices consist of height and inclination adjusters which, upon deviation from the desired height or the desired transverse inclination, in each case activate control cylinders on the left and right side of the finishing machine via electromagnetic valves so that a corresponding corrective adjustment takes place at drawing arms via which the laying beam is articulated height-adjustably to the body of the finishing machine.

Two designs are used, namely a. Adjustment of the control cylinder on one side of the finishing machine by a height adjuster and of the control cylinder on the other side by an inclination adjuster;
b. Adjustment of the control cylinders on both sides of the finishing machine by height adjusters.

Reference wires, along which on one or both sides of the finishing machine a sensor is guided for determining the actual value for the height adjuster, the desired value of which is set by hand via a spindle, are usually arranged along the laying section as a reference for the laying height. The stretching of the reference wires is very expensive and means that work is carried out with as small a number of support points as possible. Consequently, the reference wire inevitably sags under its own weight and the weight of the height sensor, and also with a rise in temperature, giving rise to corresponding unevennesses.

The problem with using the inclination adjuster is that alterations of the transverse inclination of the road, as are necessary in particular in the transitional sections before and after curves, must be made by hand. The accuracy of the adjustment consequently depends on the care and expertise of the operator.

The object of the invention is to provide a road-finishing machine of the type mentioned at the beginning which enables transverse inclination values to be maintained automatically according to a predetermined profile plan, for example in transitional sections.

This object is achieved in that a path measurement device is provided, the output signals of which can be fed to an onboard computer, the onboard computer being provided along the laying path with a data store for storing the length of a transitional section and the differential value of the transverse inclination, which differential value is to be maintained between the starting and finishing point of the transitional section, and it being possible for the desired values, which can be predetermined and are calculated by the onboard computer for the inclination adjuster, to be altered continually by the onboard computer depending on the road surface from the starting to the finishing point.

In transitional sections, in particular before and after curves, where the transverse inclination alters, the length of the transitional section and the differential value of the transverse inclination, which differential value is to be maintained between the starting and finishing point of the transitional section, are input into an onboard computer. For each point of the transitional section, the onboard computer calculates the transverse inclination required and passes the calculated value as a desired value to a corresponding inclination adjuster, so that an even and continuous alteration of the inclination results, and consequently a corresponding improvement in the quality of the laid road.

The supporting medium present to be built on is advantageously used as a reference for the laying height. Unevennesses present in the supporting medium are first detected by levelling at determined measuring points (stations) along the road to be finished and input into the onboard computer as station-related height corrections. During the laying of the layer, the respective height of the supporting medium and the station are determined in particular by a measuring wheel which is arranged on the feeler arm of a height adjuster. The determination of the height-correction values takes place on a line, on which the measuring wheel runs during the laying, parallel to the longitudinal axis of the road. According to the input data, the corresponding height correction is carried out for each station via control members acting upon the laying beam, the height correction being continually altered between the stations from one input value to the other in dependence on the path covered by the road-finishing machine. Unevennesses present in the supporting medium are in this way levelled out and a virtually even layer is laid.

By using at least one measuring wheel simultaneously as a height sensor, the use of reference wires or the like can be dispensed with.

At the same time, the onboard computer can be used for determining, editing, storing and making available at every point of the laid section data which are important for the use of the road-finishing machine when producing pavements. These data include the quantity of mix actually laid since the beginning of the laying or its deviation from a desired quantity, the current and average speed of advancement and the resulting degree of efficiency of the laying.

Further embodiments of the invention are to be found in the following description and the subclaims.

The invention will be described in more detail below with reference to the exemplary embodiment illustrated in the attached figures.

FIG. 1 diagrammatically shows a road-finishing machine in plan view.

Figure 2:
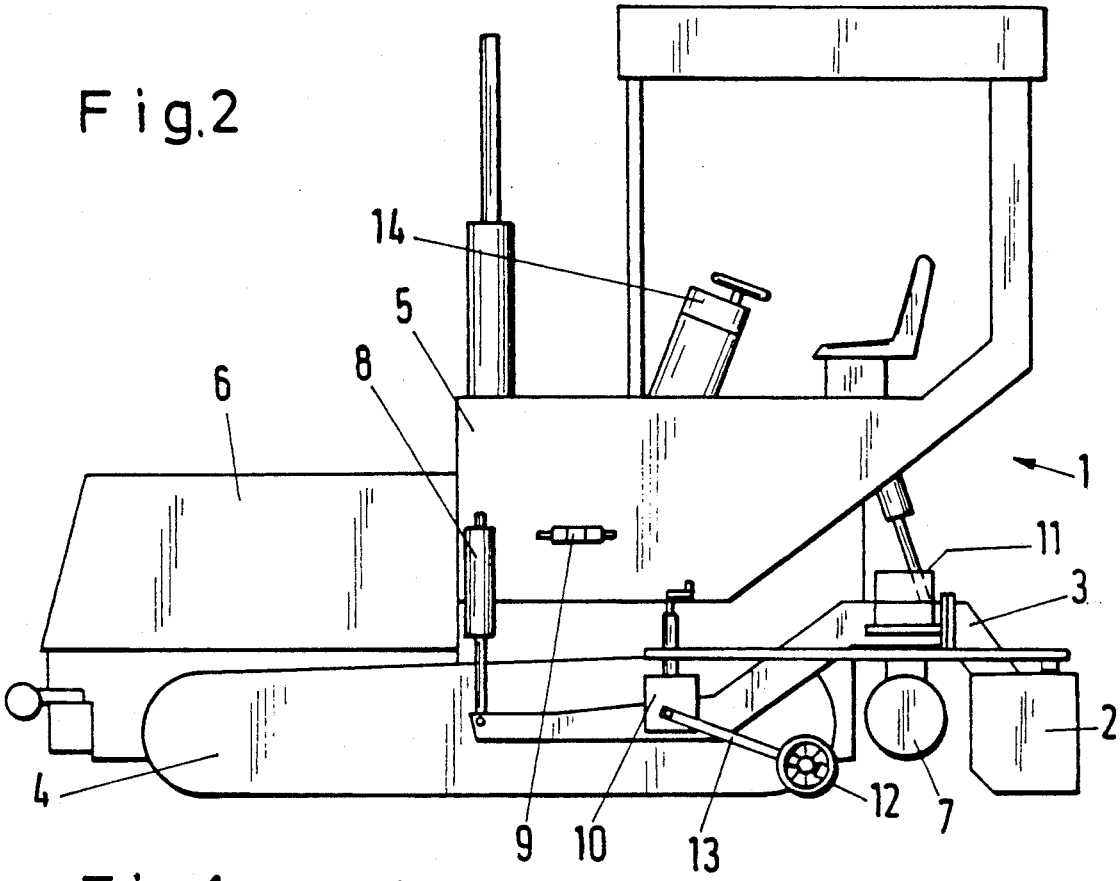
FIG. 2 shows the road-finishing machine in FIG. 1 in side view.
Figure 1:
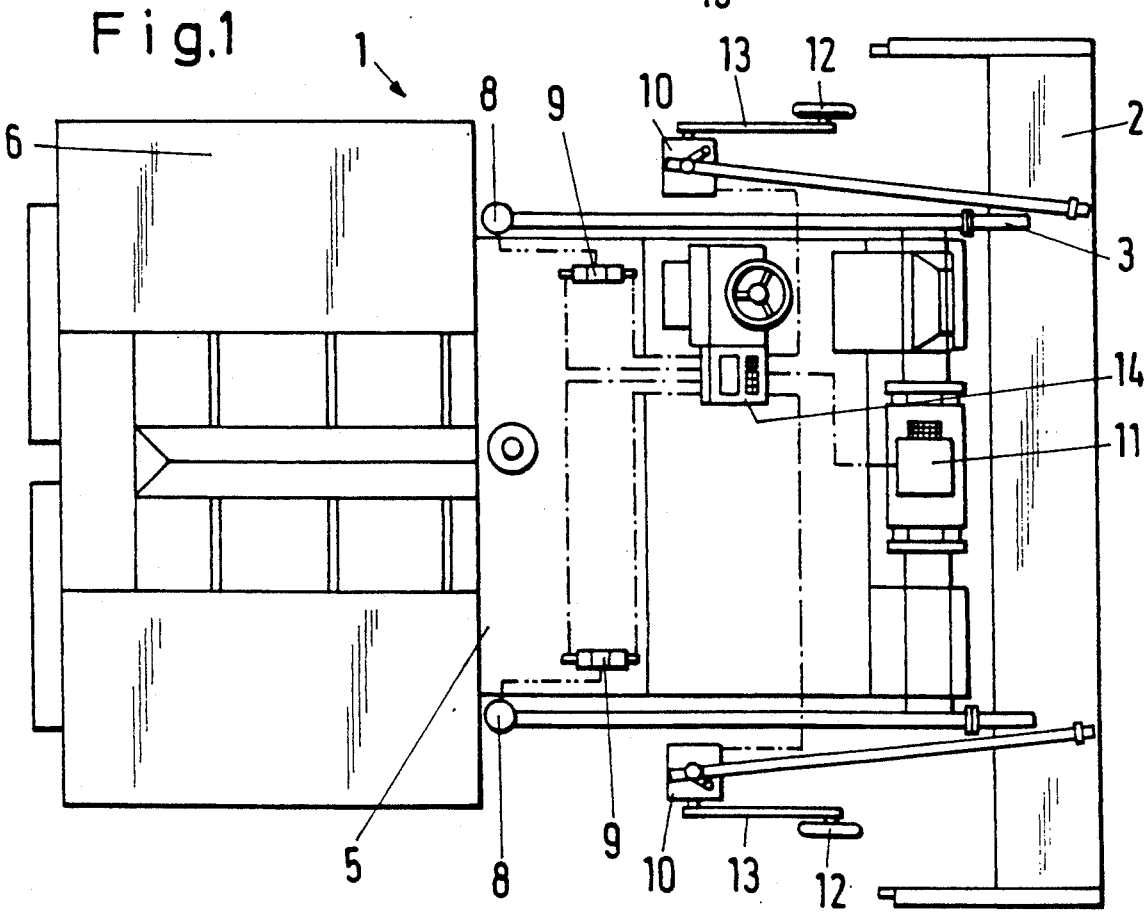

The road-finishing machine 1 represented diagrammatically in FIGS. 1 and 2 comprises a laying beam 2, which is articulated height-adjustably via drawing arms 3 to the body 5 of the road-finishing machine 1, provided, for example, with tracklaying gear 4. Laying material, which is contained in a material skip 6 at the front end of the body 5, is fed to the laying beam 2, which is situated at the rear side of the body 5, and is spread by means of a spreading screw 7 over the width of the laying beam 2 which lays the laying material, compacted to a predetermined layer thickness.

Control members 8 in the form of control cylinders, with pistons which can be admitted on both sides and corresponding distributing valves 9 for adjusting the piston and consequently the height of the laying beam 2 with height adjusters 10, serve to adjust the height of the laying beam 2 on one or both of its sides. An inclination measurement device on the laying beam 2, which supplies actual values for the transverse inclination of the laying beam 2 for an inclination adjuster 11, is integrated into the latter. The inclination adjuster 11 adjusts the transverse inclination of the laying beam 2 according to a predetermined desired value via one of the control members 8, the other serving for the height adjustment.

In addition, one or two measuring wheels 12 for measuring the section covered by the road-finishing machine 1 are provided, which run on the supporting medium for the layer to be laid adjacent to the respective outer edge of the laying beam 2, preferably arranged symmetrical with the longitudinal axis of the road-finishing machine 1 and, in the exemplary embodiment shown, are joined via a pivotable arm 13 to a measured value receiver, integrated in the height adjuster 10, for the section of path covered by the measuring wheel 12 as well as for the angle of the arm 13 relative to a reference plane for maintaining a height measurement. While both the height measurement and the inclination measurement usually result in an analog signal, the path measurement usually gives a digital signal.

Figure 3:
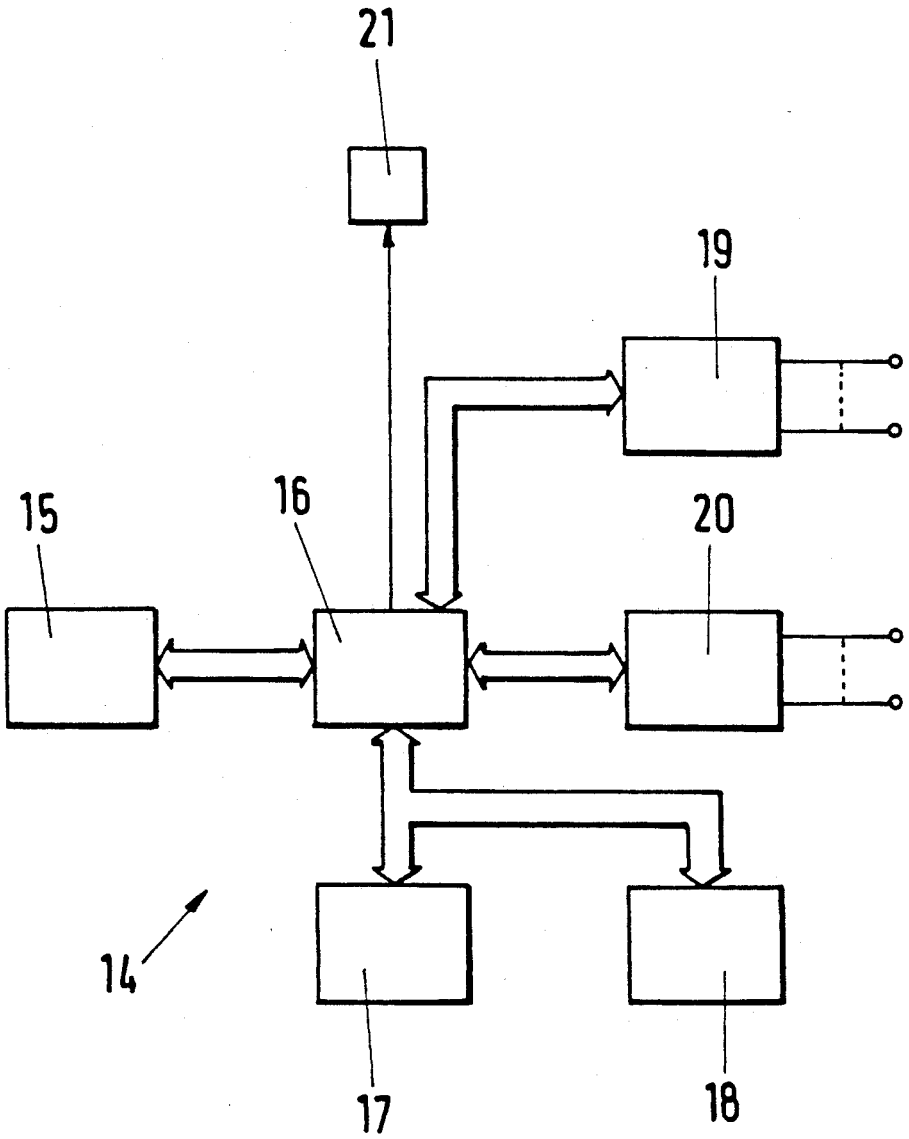
FIG. 3 shows a block diagram of an onboard computer for the road-finishing machine in FIGS. 1 and 2.

The road-finishing machine 1 has, as shown in FIG. 3, an onboard computer 14 with an input keyboard 15, which at the same time has a display field, with a microprocessor 16, a data store 17, a read-only memory 18 for the operating system, an analog input and output stage 19 and a digital input and output stage 20. The signals representing the actual values of the height and inclination measurement are fed to the microprocessor 16, as are the signals representing the actual value of the path measurement.

Desired values, input via the input keyboard 15, for the height correction or the layer thickness of the layer to be laid are stored for each station in the data store 17. These desired values were first determined on the laying section. For the stations, i.e. in corresponding dependence on the path measurement, the microprocessor 16 passes the desired values stored in the data store 17 on to the height adjusters 10 so that corresponding height corrections corresponding to the unevennesses of the supporting medium are carried out. A preferably linear alteration of the desired value for the laying height from one stored value to the other takes place between the predetermined stations, which do not have to be equidistant, via the microprocessor 16 continually in dependence on the path covered.

The desired value of the transverse inclination is likewise continually altered via the microprocessor 16 using a predetermined stored differential value of the transverse inclination between a starting and a finishing point over the length of the transitional section between the starting and finishing point in linear dependence on the length and is fed to the inclination adjuster 11.

In the embodiment shown, two measuring wheels 12 are provided at a distance from the central longitudinal axis of the road-finishing machine 1 and are both connected via arms 13 to corresponding transducers so that two height measurements are made transverse to the direction of travel of the road-finishing machine and at a distance from each other.

The inclination measurement device and the inclination adjuster 11 can be dispensed with if the desired values for the height correction and the layer thickness for each side are input to the onboard computer 14.

With small laying widths, it is also possible to manage with one measuring wheel 12, which can be arranged out of center, for the path measurement but the height measurement sensors are required for the control members 8.

With retractable laying beams 2, the measuring wheels 12 may be connected to the retractable parts of the laying beam 2 so that they are situated in each case in the edge region of the laying section.

An alarm circuit 21 may be optionally provided for the acoustic and/or optical indication that predetermined desired values cannot be achieved.

The control members 8 can advantageously also be operated manually, so that for example when the onboard computer 14 fails the road-finishing machine can still operate.

Sensors scanning corresponding markings along the laying section may also be used as a path measurement device.

I claim:

1. An improved road-finishing machine for forming a layer of material over a road surface, said machine being of the type including a laying beam (2), control members (8) for adjusting height and inclination of the laying beam (2) relative to the road surface, measuring sensors for producing output signals, and height and inclination adjusters (10, 11) for controlling the control members (8) according to the predetermined desired values, wherein the improvement comprises a path measurement device (1) which provides output signals corresponding to path elevation, an onboard computer (14) having a data store (17) for storing a length of a transitional section and a differential value of the transverse inclination, which differential value is to be maintained between starting and finishing points of the transitional section, wherein the desired values can be predetermined and are calculated by the onboard computer (14) for the inclination adjuster (11), and are altered continually by the onboard computer (14) depending on the road surface from the starting to the finishing point.

2. Road-finishing machine according to claim 1, characterized in that the path measurement device (12) comprises at least one measuring wheel revolving inside the working width of the laying beam (2).

3. Road-finishing machine according to claim 2, characterized in that the measuring wheel (12) is simultaneously designed as a height measurement sensor (13).

4. Road-finishing machine according to one of claims 1 to 3, characterized in that the data store (17) is set up for the storing by stations of desired values for the height correction or the layer thickness along the laying path and the desired values which can be predetermined by the onboard computer (14) for the adjusters (10) can be calculated continually by the onboard computer (14) depending on the road surface from one stored desired value to the next.

5. Road-finishing machine according to claim 1, characterized int hat the desired values fed to the adjusters (10, 11) can be altered linearly from one stored desired value to another.

6. Road-finishing machine according to claim 2, characterized in that the measuring wheel (12), or each measuring wheel (12), advances relative to the laying beam (2).

7. Road-finishing machine according to claim 2, characterized in that one measuring wheel (12) is provided in each case on both sides of the longitudinal axis of the road-finishing machine.

8. A road-finishing machine comprising:

a tractor;

a pavement laying beam;

means for supporting the laying beam on the tractor and allowing relative adjustment of height and transverse inclination of the beam relative to a road surface on which the pavement is to be laid;

means for measuring a contour of the road surface; said means including at least one vertical height measurement wheel revolving inside a working width of the laying beam and producing an output signal; and a controller on the tractor for adjusting the height and transverse inclination of the laying beam responsive to both a predetermined program and said output signal from the measuring means.

9. A road-finishing machine as in claim 8, wherein the support means includes separate piston and cylinder assemblies mounted on opposite sides of the tractor and drawing arms which connect the piston and cylinder assemblies to opposite sides of the laying beams.

10. A road-finishing machine as in claim 8, wherein the means for measuring further includes a second measuring wheel revolving inside the working width of the layer beam.

11. A road-finishing machine as in claim 8, wherein the means for measuring further includes a height adjuster and an arm pivotably connecting the measuring wheel to the height adjuster.

12. A road-finishing machine as in claim 8, wherein the controller includes a data store for storing first desired values for height correction and layer thickness along the path and second desired values which are determined by the controller depending on the road surface from one stored desired value to the next.

* * * * *